United States Patent [19]

Wagner et al.

[11] 4,336,839

[45] Jun. 29, 1982

[54] DIRECT FIRING DOWNHOLE STEAM GENERATOR

[75] Inventors: William R. Wagner, Los Angeles; David E. Wright, Canoga Park; Robert L. Binsley, Sepulveda, all of Calif.

[73] Assignee: Rockwell International Corporation, El Segundo, Calif.

[21] Appl. No.: 202,990

[22] Filed: Nov. 3, 1980

[51] Int. Cl.[3] ..... E21B 36/00

[52] U.S. Cl. ..... 166/59; 122/4 R; 431/158; 431/190; 166/303

[58] Field of Search ..... 122/4 R, 31 R; 431/4, 431/190, 158, 350; 166/57, 59, 302, 303

[56] References Cited

U.S. PATENT DOCUMENTS

| | | | |
|---|---|---|---|
| 2,725,929 | 12/1955 | Massier | 431/158 |
| 3,254,721 | 6/1966 | Smith | 166/59 |
| 3,385,381 | 5/1968 | Calaman | 431/158 X |
| 3,456,721 | 7/1969 | Smith | 166/59 |
| 3,980,137 | 9/1976 | Gray | 166/303 |
| 4,078,613 | 3/1978 | Hamrick et al. | 166/302 |

*Primary Examiner*—Edward G. Favors

*Attorney, Agent, or Firm*—H. F. Hamann; Harry B. Field

[57] ABSTRACT

Direct firing downbole steam generator basically comprises an injector assembly axially connected with a combustion chamber. Downstream of the combustion chamber and oriented so as to receive its output is a heat exchanger wherein preheated water is injected into the heat exchanger through a plurality of one-way valves, vaporized and injected through a nozzle, packer and check valve into the well formation.

9 Claims, 6 Drawing Figures

DIRECT FIRING DOWNHOLE STEAM GENERATOR

BACKGROUND OF THE INVENTION

1. Field of the Invention

This invention pertains to steam generators and more specifically to downhole steam generators for generating high pressure steam at the bottom of oil well bores.

2. Description of the Prior Art

The use of steam for recovering crude oil was initiated in the United States in 1960. It found its first use in the stimulation of wells drilled into reservoirs containing low gravity crude oils. Its use throughout California increased rapidly until, by the mid-sixties, the production of oil by steam stimulation exceeded 100,000 barrels a day.

Steam stimulation involves the injection of steam into a producing well for a relatively short period of time, a few days to a month or so, allowing the well to "soak" for several days or a week or two, and then returning the well to production. The steam generator is then used for injection into a second well and, in turn, a third or fourth, etc. Typically, wells are stimulated once every three months to once every year. To facilitate such operation, the steam generator was usually skid-mounted, or the steam was piped to several nearby wells that it would supply in turn.

Steam stimulation, because of the rapid production following upon the expenditure for generating steam, is an intrinsically profitable operation. The amount of oil that can be recovered from a reservoir is limited by the fact that the reach of such a technique into the reservoir is limited. As the oil is heated and drained from the zone immediately around the well bore, there is a subsequent influx of oil from the reservoir into the zone around the well bore.

The steam drive has been developed as an additional or supplementary operation to the steam soak to achieve a greater overall recovery efficiency of crude oil from the reservoir. In the steam drive, steam is injected into alternate wells (drilled in a repeating pattern) and the oil is displaced by the injected steam into the offsetting wells. Field operations have confirmed the earlier physical model studies that recovery can exceed 50% of the original oil in place, but at lower oil/steam ratios than those achieved in steam/soak operations. The lower oil/steam ratios arise from the fact that a signficantly greater fraction of the injected heat is lost because of the larger time of contact and contact area between the swept reservoir zone and the adjacent base and cap rocks.

Production of crude oil by steam stimulation and steam drive had reached some 200,000 barrels a day by 1978. The enhanced oil recovery processes are the only ones, over and above water flooding, that have proved to be economically successful to date.

The use of steam injection has been limited to date to heavy oil reservoirs that contain a very high saturation of oil, not having been depleted significantly by primary operations and water flooding. The latter, of course, is not applicable in these heavy oil reservoirs because of very adverse mobility ratio. The high oil staturation has been required so that the recovery of crude oil is sufficient to secure a significant sales volume after provision of the fuel requirements for steam generation.

Recently, attention has been placed on the extension of the steam drive to reservoirs that have been previously considered poor candidates for the process. The limits on the applicability of the steam drive arise essentially from a combination of circumstances that lead to low oil/steam ratios (oil produced/steam injected): too low an oil saturation (insufficient energy is recovered from the reservoir to provide a profitable sales volume after deducting fuel requirements), too thin a reservoir (proportionately greater fractional losses of heat to base rock and cap rock), and too deep and too high a reservoir pressure (high heat losses in the well tubulars and low steam quality at the sand face) are the principal factors limiting the extension of this scheme to crude oil reservoirs not currently amenable to the process.

This invention is aimed at removing the restraint imposed by depth and reservoir pressure on the efficiency of the steam drive operation.

In current steam drive operations, an average reservoir depth might be considered to be about 1000 feet (ranging from 500 to 2000 feet) and average injection pressures somewhere between 300 and 400 psi (ranging from 50 psi to 500 psi). Injection rates range from 500 to 2000 barrels of water (converted to steam) per day, and the steam leaves the generators at a quality of 70% to 80%. Heat losses between the generator and the sand face may run about 10% (after equilibrium conditions become established in the bore hole), and the result is that the quality of the steam is reduced to some 60% at the sand face. Higher pressures are required in order to inject the steam into higher pressure reservoirs. However, due to the fact that heat losses in the greater length of well tubulars are still greater than normal, and because the latent heat per pound of steam decreases as the sensible heat per pound increases with pressure, the quality of the steam at the sand face may fall to 40% or less.

Theoretical studies indicate that the displacement efficiency of steam decreases as the steam quality entering the reservoir decreases. This conclusion can be reached intuitively once it is realized that the residual oil saturation in a steam-filled porous medium is quickly reduced to values less than 10% of the pore volume, whereas the residual saturations to hot water are far higher (25% to 50%) and are approached only gradually. Field studies have corroborated the superiority of steam drives over hot water drives. Thus, a technically successful downhole steam generator would provide the advantages of lower heat losses in surface and downhole tubulars and a higher steam quality at the sand face. Capital and operating costs could offset these benefits and, therefore, it is the goal of this invention to provide the design of a suitable downhole steam generator that will have a positive economic ratio, i.e., benefits greater than costs.

SUMMARY OF THE INVENTION

Accordingly, there is provided by the present invention a direct firing downhole steam generator (DHSG) which comprises an injector assembly, a combustion chamber, a heat exchanger and injection nozzle. The injector assembly further comprises a fuel spray nozzle, an air source and means for mixing the fuel and air, and an ignition means for igniting the fuel/air mixture. The injector assembly is axially connected to the water cooled combustion chamber wherein the cooling water provides both the means for preventing combustion chamber burnout as well as means for preheating the water prior to its being injected into the combustion products in the heat exchanger zone wherein the water is vaporized. In order to contain the injected steam and combustion products within the well, a standard packer and check valve arrangement is modified to receive the DHSG.

OBJECTS OF THE INVENTION

Therefore, it is an object of the present invention to provide an economic downhole steam generator capable of producing at least about 1000 barrels of 85% quality steam per day at from at least about 600 to about 3200 psia and at well depths ranging to about 5000 feet.

Another object of the present invention is to provide a downhole steam generator capable of being installed in well casings less than about a twelve-inch diameter.

Still a further object of the present invention is to provide a downhole steam generator having a downhole operational life of at least ten years.

Yet a further object of the present invention is to provide a downhole steam generator capable of having an eighteen-month minimum interval between maintenance.

Another object of the present invention is to provide a downhole steam generator capable of injecting both steam and combustion products into the formation.

Other objects, advantages and novel features of the present invention will become apparent from the following detailed description of the invention when considered in conjection with the accompanying drawings wherein like numerals represent like elements throughout.

DESCRIPTION OF THE PREFERRED EMBODIMENTS

Figure 1:
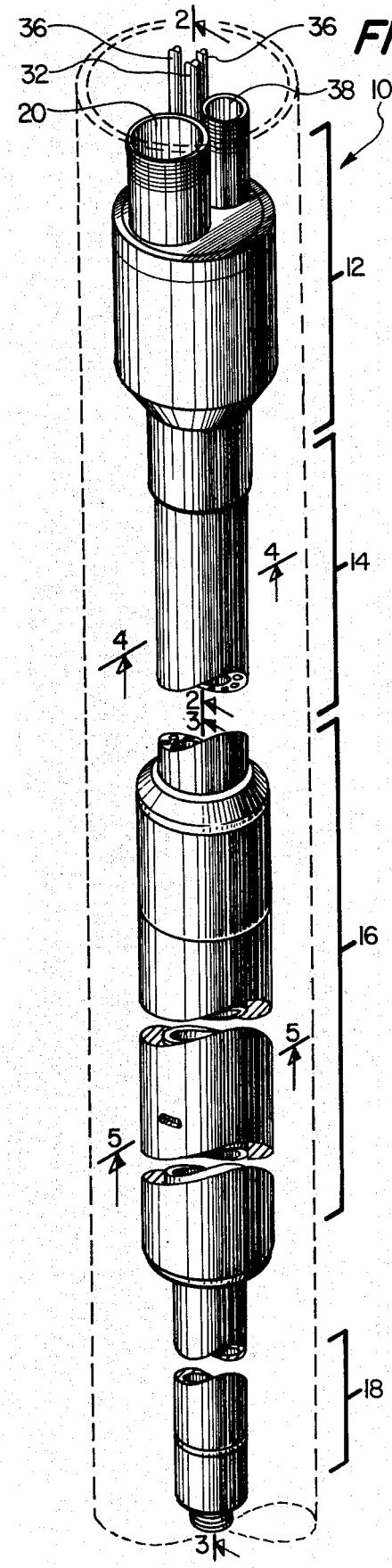
FIG. 1 is a perspective view of the direct firing downhole steam generator.

Turning now to FIG. 1, there is shown a perspective view of the direct firing downhole steam generator (DHSG) generally designated 10. DHSG 10 basically comprises an injector assembly generally designated 12 axially connected with the combustion chamber generally designated 14. Downstream of combustion chamber 14 and connected so as to receive its output is the heat exchanger section generally designated 16 and nozzle 18.

Figure 2:
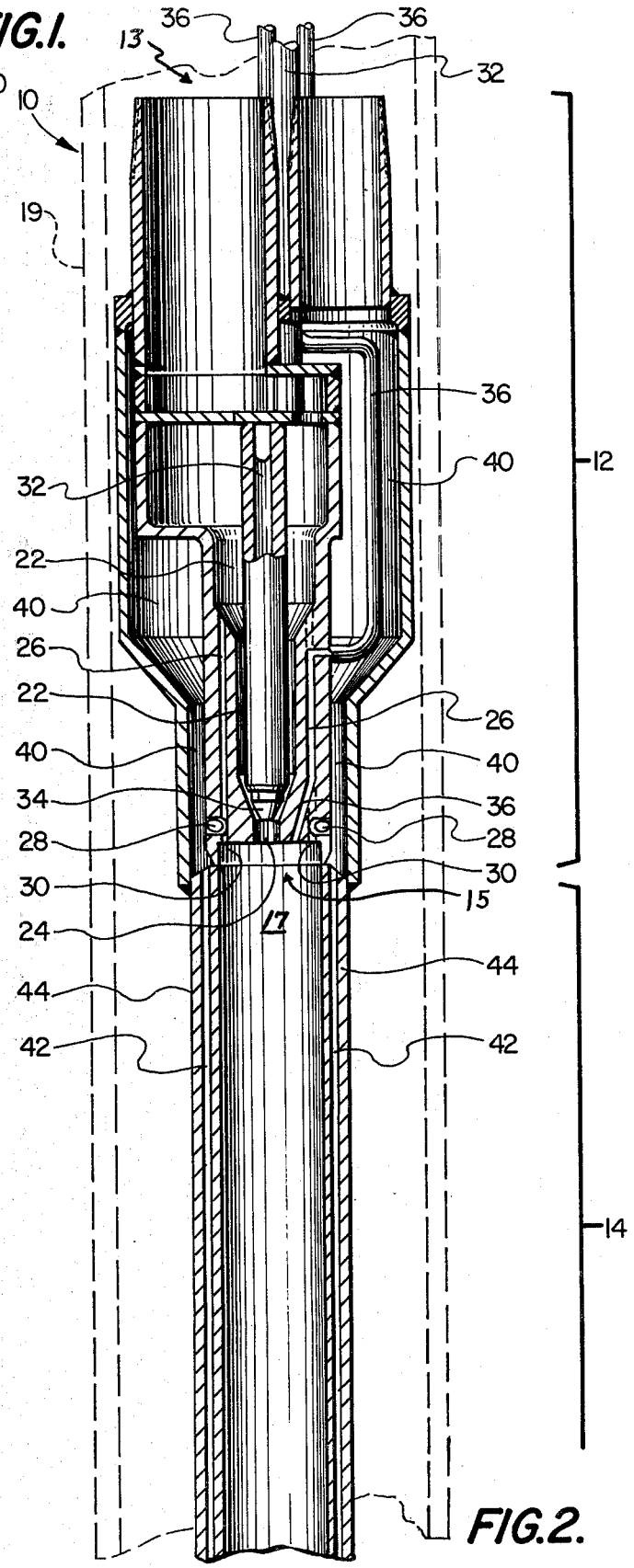
FIG. 2 is a longitudinal cross-section of FIG. 1 taken along line 2–3 and showing the injector and combustion chamber zones.

The injector assembly 12 can be more clearly analyzed by referring to FIG. 2. In the present system air, fuel and water are each separately compressed and piped down individual lines within the well casing 19 to the inlet zone 13 of DHSG 10 at the well bottom. The compressed air enters injector assembly through air inlet 20, flows down air annulus 22 and mixes with the atomized fuel in the mixing zone generally designated 24. Concurrently, air is bled through air bleed lines 26 and, although it can be fed directly into the combustion chamber 14, it is preferably fed into air manifold 28, and into combustion chamber 14 through a plurality of air boundary layer ports 30. While air is being fed into DHSG 10, pressurized fuel is channeled down fuel line 32 and into and through fuel atomizing nozzle 34. The fuel is then sprayed into mixing zone 24 where fuel/air mixing and ignition occurs. Ignition of the fuel/air mixture is effected by flowing the ignition medium down ignition line 36 and into mixing zone 24. Although any igniter system will work to a certain degree, the preferred ignition system uses a hypergolic slug such as TEA/TEB (Triethylaluminum/Triethylboron) that reacts spontaneously with air. To effect proper ignition in the preferred system, a "U" tube is used. This permits the TEA/TEB to be pumped down the well bore to DHSG 10 and into a receiving tank. Then line 36 is purged with nitrogen so as to insure that the ignition wave goes into DHSG 10 and cannot proceed back up line 36 to the surface.

Concurrently with the ignition process, water is pumped down water line 38 into annulus 40. As the water flows from injector assembly 12 and injector outlet zone 15, it enters combustion chamber inlet zone 17 and water channels 42 which are longitudinally oriented within wall 44 of combustion chamber 14. Conveying the water through combustion chamber walls 44 in this manner serves the dual purpose of cooling the combustion chamber and heating the water prior to its injection into the combustion gases in the heat exchanger zone 16.

Figure 3:
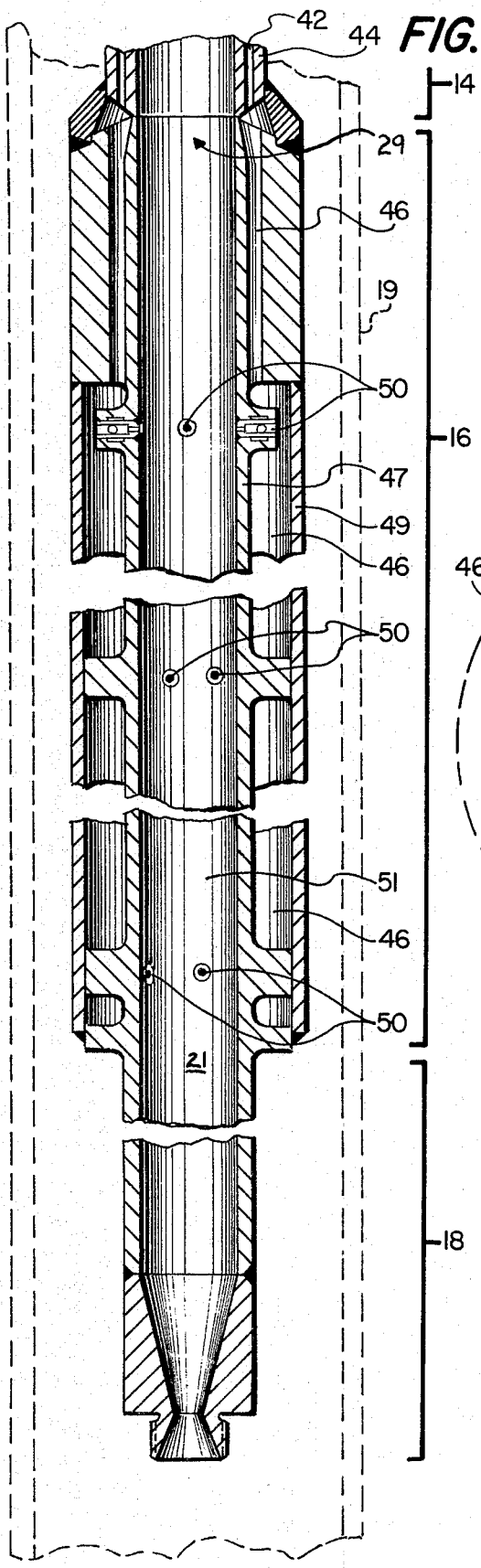
FIG. 3 is a longitudinal cross-section of FIG. 1 taken along line 2–3 and showing the heat exchanger and nozzle zones.
Figure 4:
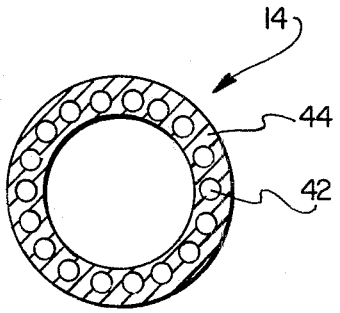
FIG. 4 is a transverse cross-section of FIG. 1 taken along line 4—4 and showing the combustion chamber.
Figure 5:
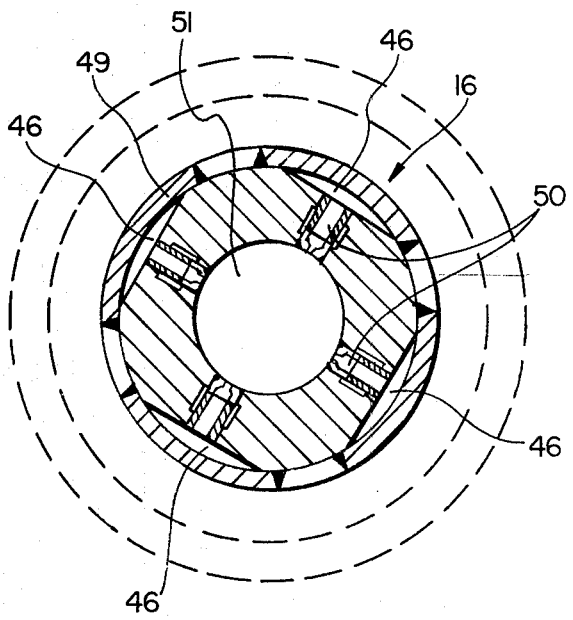
FIG. 5 is a transverse cross-section of FIG. 1 taken along line 505 and showing the water injections.
Figure 6:
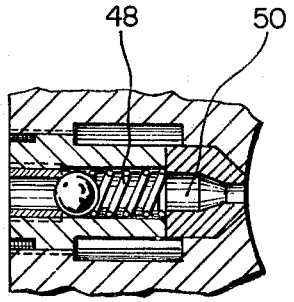
FIG. 6 is a cross-sectional view of a typical one-way valve for use at water injection points.

Turning now to FIG. 3, there is shown a longitudinal cross-section of the heat exchanger zone 16 being defined by inlet zone 19 and outlet zone 21, and a nozzle 18. As the high pressure combustion products flow down core 51 of heat exchanger 16, preheated water flows down and fills hot water annulus 46 which is further defined by inner wall 47 and outer wall 49. When the water pressure within annulus 46 reaches the predetermined level, one-way valve 48 opens and allows the water to be injected through water injection nozzle 50 into the core 51 of said heat exchanger 16. As the water and combustion gases mix, the water is converted into steam. Thereafter, both the combustion products and steam are driven through nozzle 18, through the packer and its check valve (not shown), and into the formation. It should be noted that one-way valves are preferably arranged in sets and most preferably in sets of four wherein each valve is radially oriented 90° apart from the adjacent valve.

By way of illustration and not limitation, the following design criteria are set forth for a typical DHSG 10. The basic DHSG 10 design is capable of 15,000,000 Btu/hr total heat output, providing 85% quality steam at injection pressures of from about 600 to about 3200 psia. The preferred operating pressure is, however, about 1500 psia. The DHSG 10 and uphole equipment can be operated at reduced injection pressures, as required by the well formation. The DHSG 10 is basically designed to operate in any attitude from vertical to near horizontal. At the lower pressure levels the total heat output can be maintained at 15,000,000 Btu/hr (this is equivalent to a steam flow of approximately 900 barrels per day). The 600 psia injection pressure level requires an air flowrate of approximately 3.4 lb/sec at a compressor discharge pressure of approximately 1180 psia.

The DHSG 10 unit (for a test installation and later production installations) is designed to fit into an existing seven-inch-diameter well casing and has a maximum diameter of 5.5 inches.

With 85% quality steam injected at 600 psia, the partial pressure of the steam vapor is about 380 psia. The saturation temperature of the steam and, therefore, the injection temperature of all fluids is 440° F. About 50% of the injected fluid is supplied by the feed water. The remaining 50% comes from the products of combustion.

The total heat input to the reservoir (i.e., 15,000,000 Btu/hr) is truly a total heat, i.e., it includes the sensible heat delivered by the injected combustion gases as well as the sensible and latent heat carried by the water. The steam heat output and primary design criteria are shown in Table 1.

DHSG INSTALLATION CAPABILITIES

| | DESIGN CAPABILITY |
|---|---|
| DHSG INSTALLATION CAPABILITY | |
| TOTAL HEAT OUTPUT, BTU/HR | 15,000,000 |
| STEAM HEAT OUTPUT, BTU/HR | 13,750,000 |
| COMBUSTION PRESSURE, PSIA | 1510 |
| INJECTION PRESSURE, PSIA | 1500 |
| STEAM, FLOW, BARRELS/DAY | 978 |
| STEAM QUALITY, % | 85 |
| INJECTION TEMPERATURE, F. | 538 |
| AIR COMPRESSOR SUPPLY REQUIREMENTS | |
| FLOW (DRY AIR), LB/SEC | 3.4 |
| PRESSURE, PSIA | 1700 |
| FUEL REQUIREMENTS | |
| TYPE | NO. 2 |
| FLOW, LB/SEC | 0.23 |
| WATER REQUIREMENTS | |
| TYPE | SOFTENED |
| FLOW, LB/SEC | 3.4 |
| IGNITER | HYPERGOLIC (TEA/TEB) |

Thus, it is apparent that there has been provided by the present invention a downhole steam generator capable of producing at least 1000 barrels per day of 85% quality steam at 600 to 3200 psia and at well depths as deep as from 2500 to 5000 feet.

It is to be understood that what has been described is merely illustrative of the principles of the invention and that numerous arrangements in accordance with this invention may be devised by one skilled in the art without departing from the spirit and scope thereof.

What is new and desired to be secured by Letters Patent of the United States is:

1. A direct firing downhole steam generator, comprising:

an injector assembly being defined by an inlet zone, an outlet zone and circumferential walls and having:

means for introducing air into said injector assembly;

means for introducing fuel into said injector assembly;

means for mixing said fuel and said air;

means for igniting said fuel air mixture; and means for introducing water into and through said circumferential walls of said injector assembly;

a combustion chamber being defined by an inlet zone, an outlet zone and circumferential walls and wherein said inlet zone of said combustion chamber is axially connected to said outlet zone of said injector assembly, and wherein said combustion chamber walls comprise a plurality of longitudinally-oriented water channels and wherein said water channels are connected to said outlet zone of said injector assembly so as to receive the water from said injector assembly;

a heat exchanger being defined by inlet and outlet zones and inner and outer circumferential walls and wherein said inlet zone of said heat exchanger is axially connected to the outlet zone of said combustion chamber, and wherein the inlet zone of the annulus formed by said heat exchanger inner and outer walls is connected so as to receive the output of said water channels and wherein said heat exchanger further comprises a plurality of one-way valves oriented so as to permit water to be injected from said annulus into the core of said heat exchanger; and a nozzle disposed so as to receive the output of said heat exchanger and inject high pressure products into a formation.

2. The direct firing downhole steam generator of claim 1 wherein said means for introducing air into said injector assembly comprises:

an air inlet;

an air annulus connected so as to receive the output of said air inlet; and a plurality of air bleed lines connected so as to receive the output of said air inlet and so as to inject an air boundary layer along the interior surface of said combustion chamber.

3. The direct firing downhole steam generator of claim 2 wherein said air bleed lines further comprise an air manifold disposed so as to receive the output of said air bleed lines and a plurality of air boundary layer ports disposed so as to convey air from said manifold into said combustion chamber.

4. The direct firing downhole steam generator of claim 1 wherein said means for introducing fuel into said injector assembly comprises an axially-oriented atomizing spray nozzle.

5. The direct firing downhole steam generator of claim 1 wherein said means for igniting said fuel/air mixture comprises a hypergolic slug.

6. The direct firing downhole steam generator of claim 5 wherein said hypergolic slug is Triethylaluminum/triethylboron (TEA/TEB).

7. The direct firing downhole steam generator of claim 1 wherein said one-way valves are radially oriented.

8. The direct firing downhole steam generator of claim 1 wherein said one-way valves are grouped in sets and wherein each set is disposed so as to inject water into the heat exchanger core at a predetermined distance from said combustion chamber.

9. The direct firing downhole steam generator of claim 8 wherein each set of said one-way valves further comprises four radially-oriented valves 90° apart.

* * * * *